US006990778B2

(12) United States Patent
Passeno

(10) Patent No.: US 6,990,778 B2
(45) Date of Patent: Jan. 31, 2006

(54) BRICK VENEER ASSEMBLY

(76) Inventor: James K. Passeno, 116 W. State, Grant, MI (US) 49327

( * ) Notice: Subject to any disclaimer, the term of this patent is extended or adjusted under 35 U.S.C. 154(b) by 92 days.

(21) Appl. No.: 10/245,978

(22) Filed: Sep. 18, 2002

(65) Prior Publication Data

US 2004/0050003 A1 Mar. 18, 2004

(51) Int. Cl.
*E04F 13/08* (2006.01)

(52) U.S. Cl. ..... 52/385; 52/387; 52/434; 52/562; 52/506.08

(58) Field of Classification Search ..... 52/562, 52/610, 506.08, 384, 385, 386, 387, 591.4, 52/609, 312, 314, 311.2, 391, 675, 541, 434, 52/482; 405/284; 211/87.01, 94.01
See application file for complete search history.

(56) References Cited

U.S. PATENT DOCUMENTS

| | | | |
|---|---|---|---|
| 1,861,359 A | 5/1932 | Pyron | |
| 1,975,769 A | 10/1934 | Cederholm et al. | |
| 2,087,931 A | 7/1937 | Wallace et al. | |
| 2,924,963 A | 2/1960 | Taylor et al. | |
| 2,938,376 A | 5/1960 | Workman et al. | |
| 3,703,795 A | 11/1972 | Mattes | |
| 3,780,483 A | 12/1973 | Mattes | |
| 3,886,704 A | 6/1975 | Mattes | |
| 4,662,140 A | 5/1987 | Porter et al. | |
| 4,803,821 A | 2/1989 | Funaki | |
| 4,856,245 A | 8/1989 | Osawa | |
| 4,856,246 A | 8/1989 | Shimasaki | |
| 4,987,712 A | 1/1991 | Mancuso | |
| 5,473,851 A | 12/1995 | Northrup, Jr. | |
| 5,930,964 A | 8/1999 | Boehning | |
| 6,098,363 A | 8/2000 | Yaguchi | |
| 6,315,489 B1 * | 11/2001 | Watanabe | 403/381 |

FOREIGN PATENT DOCUMENTS

| | | |
|---|---|---|
| DE | 3521 795 A1 | 1/1987 |
| EP | 0 190 377 A1 | 8/1986 |
| JP | 3-122360 * | 10/1989 |

OTHER PUBLICATIONS

American Brick Co. EZ–Wall 1997.
American Brick Co. Insulock Thin Brick System 1997.

* cited by examiner

*Primary Examiner*—Carl D. Friedman
*Assistant Examiner*—Chi Q. Nguyen
(74) *Attorney, Agent, or Firm*—VanOphem & VanOphem P.C.

(57) ABSTRACT

A brick veneer assembly having improved accommodation of brick tolerances, simple assembly, and lower cost relative to the prior art. A plurality of bricks having a tapered locating surface are provided. A support panel includes horizontal rows of L-shaped retainers and corresponding rows of holes. Each L-shaped retainer further includes a leg portion extending away from the support panel, and a foot portion that depends downwardly away from the leg portion. The tapered locating surface of each brick is inserted into the L-shaped retainer thereby elastically deforming the foot portion away from the support panel such that the tapered locating surface is subjected to a restraining force creating a force component pushing the back of the brick against the support panel and a force component downwards pushing the bottom of the brick to seat on the adjacent row of L-shaped retainers defining a clearance gap between the top of the brick and the adjacent row of L-shaped retainers so that when mortar is applied between the bricks the mortar will flow into the clearance gap and holes to interlock the brick with the support panel.

14 Claims, 5 Drawing Sheets

BRICK VENEER ASSEMBLY

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to an external wall for a building. More specifically, this invention is directed to an improved support panel to secure external wall forming members such as brick, tiles or stones to complete an external wall assembly for a building.

2. Description of the Related Art

Brick walls have been used for centuries as a premium building material due to their strength, beauty, and durability. Unfortunately, brick walls are typically laid brick-by-brick, which tends to be time consuming, labor intensive, and therefore expensive. Thin brick veneer was developed as a means for achieving the beauty and durability of brick walls without the associated expense.

Thin brick veneer is produced using a variety of manufacturing methods including thin bed set, thick bed set and prefabrication in cast molds. Thin brick panels can be premanufactured or can be assembled to a wall of a building on-site. Thin brick panels generally include a substratum, such as steel, aluminum, plywood, asphalt-impregnated fiber board, cementitious board, polyurethane, and polystyrene foam board. With the on-site assembly method, the substratum is fastened to the exterior wall of a building and an array of thin bricks are applied to the substratum, typically with an adhesive. Then mortar, or grout, is applied between the thin bricks to obtain a permanent brick veneer wall assembly.

The prior art has suggested a variety of thin brick panel constructions. For example, U.S. Pat. No. 2,924,963 to Taylor et al. teaches a method for attaching a clay veneer brick to pre-existing buildings. Taylor et al. disclose a brick unit, a wall clip, and mortar. The brick unit includes a back side, a face section, and longitudinal ribs along the top and bottom. The longitudinal ribs are beveled at a front side at a 45 degree angle. The clip is made from sheet metal and is made to resiliently receive the brick unit. The clip includes a flat upstanding lug and a bent tail lug, both of which have fastener holes punched therethrough. Extending perpendicularly from the clip are a plurality of resilient clamping members, each having a downturned lip to resiliently receive a respective longitudinal rib of a respective brick unit. The downturned lip also has an upturned flange, which, when the clip is fitted to the veneer brick, rides against the longitudinal rib of the brick unit, causing the downturned lip to deflect and resiliently retain the brick unit.

Unfortunately the clip of Taylor et al., is unnecessarily complex with many detailed bends. Moreover, an overabundance of individual clips must be handled and secured to a building just to construct a single wall, which is inefficient, labor intensive, and costly. Finally, great amounts of care and time must be given to the precise positioning of each clip to ensure that each brick is squarely aligned with respect to the other bricks.

U.S. Pat. No. 2,087,931 to Wallace et al. teaches a means for attaching bricks to a wall such that each brick is individually supported so that its position in the wall is not dependent upon the other bricks. Specifically, Wallace et al. disclose wall sheeting having a plurality of spaced apart strap members secured thereto by nails. A plurality of support clips are riveted to the strap members at regularly spaced intervals. The support clips have extending portions that are bent outwardly to form arms with inwardly bent terminals for engagement with surfaces of the bricks. The natural resiliency of the clip so constructed forces the terminals into engagement with the brick surfaces. The terminals are angularly disposed relative to the adjacent surfaces of the brick such that a sharp edge of the terminals engage the brick thereby materially increasing the tenacity of the holding action.

The Wallace et al. disclosure relies on a plurality of strap members and a plurality of support clips for applying bricks to a wall. Manufacturing all the components required for the Wallace et al. disclosure and the process of assembling the components to a wall unnecessarily incur additional labor and material cost. Furthermore, Wallace et al. do not teach a means for accommodating oversized and undersized bricks.

U.S. Pat. No. 6,098,363 to Yaguchi teaches a support panel for supporting external wall forming members, or bricks. The bricks are of rectangular parallelpiped shape, meaning they have oppositely parallel surfaces all over. The bricks each have a main surface, a rear surface, side surfaces, and end surfaces. The side surfaces include elongated upper and lower lateral extensions that define flat ledges or minor surfaces that are parallel with the main surface. The support panel includes a flat back plate and is stamped from stainless metal sheet to form parallel rows of C-shaped upper and lower engaging members terminating in respective upper and lower securing fingers. The distance between the upper and lower engaging members is substantially identical to the width of a respective brick. A brick is inserted between the upper and lower engaging members. This insertion pushes the upper lateral extension of the brick into a space defined by the upper engaging member and upper securing finger thereby causing the upper engaging member to elastically deform while the lower lateral extension of the brick is urged flat against the back plate of the support panel within the lower engaging member. As a result, the brick is clamped between the upper and lower engaging members and by the bent securing fingers.

In an alternative embodiment, each brick only has an upper lateral extension and an oppositely disposed flat side surface. Respectively, the support panel includes only rows of upper engaging members and securing fingers. Each upper engaging member has an outer, top surface and an inner bottom surface. As before, the upper lateral extension of each brick is pushed into the space defined by the respective upper engaging members such that the upper lateral extension of the brick engages the inner bottom surface of the respective upper engaging member. Simultaneously, the brick is pushed toward the back plate of the support panel until the flat side surface locates against the top surface of the respective engaging member below. Thus, the brick becomes pinched between the upper engaging member and the top of an upper engaging member from the row of upper engaging members below the brick.

In both of the Yaguchi embodiments, however, the support panel clamps on oppositely disposed parallel surfaces of the brick. This is detrimental because the size of the bricks varies significantly compared to the stamping tolerances attainable with the support panel. In other words, either one of two undesirable conditions must occur. The bricks must be held to an extremely close width tolerance to accommodate reliable and repeatable snap fit insertion to the support panel. This is extremely costly, if at all possible, on a mass production basis. Or, each brick must be oversize with respect to the distance between the rows of engaging members to ensure firm clamping of each brick. Oversize bricks will fit fine in the first row of engaging members, but will start to interfere when they are assembled to adjacent rows of engaging members because the engaging members will be filled with bricks and have no room to deflect. Alternatively, if the bricks are undersize, they will fit loosely within the engaging members thereby leading to problems. When the mortar gets applied, loose bricks will shift due to the slack and hairline cracks in the mortar may result.

From the above, it can be appreciated that thin brick panel assemblies of the prior art are not cost effectively optimized to accommodate typical brick tolerances, simplify assembly, and thus lower costs. Therefore, what is needed is a combination of a thin brick veneer assembly that incorporates novel and simple retaining features in a substratum or support panel and related features in a brick to advance the art of veneer brick assembly.

BRIEF SUMMARY OF THE INVENTION

According to the preferred embodiment of the present invention, there is provided a brick veneer assembly adapted for mounting to a wall of a building structure. The method and apparatus for making a brick veneer wall facing includes thin bricks, a support panel and mortar.

The thin bricks are generally rectangular and each brick, as viewed when assembled on a wall, has a front surface, a back surface, a top surface, a bottom surface, and opposed side surfaces. The back surface of the thin brick is in contact with the wall and is higher than the front surface of the thin brick. It is an important feature of the present invention that a surface of the brick is tapered and serves as a locater. In one embodiment, the top surface of the thin brick is tapered between the front surface and the back surface. However, the preferred embodiment of the present invention will be described hereinafter as having a stepped surface extending generally perpendicularly from the front surface toward the back surface, and a tapered locating surface between the top surface and the stepped surface. The top surface, the stepped surface and the bottom surface are approximately parallel in the preferred embodiment.

The width of each thin brick is defined between the opposed side surfaces, the height is defined between the top and bottom surfaces, and the thickness or depth is defined between the back and front surfaces. Most manufacturing processes known in the art for producing the thin bricks introduce variation such that some bricks are oversized and some are undersized. Manufacturing variation thereby defines a maximum width, height and depth, and a minimum width, height and depth.

The support panel is preferably composed of thin sheet metal, and has a front surface, a rear surface, rows of L-shaped retainers and corresponding rows of holes. The L-shaped retainers are integrally stamped from the support panel such that the holes are generated by the removal of the material from which the L-shaped retainers are formed. Each L-shaped retainer has a leg portion and a foot portion. The leg portion of each L-shaped retainer has a top surface and a bottom surface. The foot portion of each L-shaped retainer depends downward from the leg portion and toward the support panel such that initial engagement of the tapered locating surface of the thin bricks deforms the foot portion away from the support panel thereby creating an interference fit between the thin bricks and the foot portion of the L-shaped retainer.

The vertical distance between the leg portions of adjacent rows of L-shaped retainers is greater than the height of an oversized brick so that a brick can be mounted between adjacent leg portions and a clearance exists. Furthermore, the foot portion of the L-shaped retainers is long enough to engage the tapered locating surface of an undersized brick seated on adjacent L-shaped retainers directly below. In this manner, the support panel is able to accommodate variation of the thin bricks height in a manner that does not interfere with the other bricks.

The back surface of the support panel is attached to a wall of a building structure with fasteners such as nails or screws. Then, each thin brick is mounted to the support panel by approaching the panel holding the brick at an angle such that the top of the brick having the tapered locating surface is introduced into a space between the front surface of the support panel and the foot portions of a respective L-shaped retainer. Each thin brick is then pushed flat against the support panel to rest on the leg portion of the lower row of retainers, thereby deforming the foot portion of the upper row of L-shaped retainers and engaging with the brick to create an interference fit. In this manner, the thin bricks locate on the top surfaces of a respective lower row of L-shaped retainers and are interferingly restrained by a respective leg portion of the upper row of L-shaped retainers.

After the thin bricks are applied to the support panel, mortar is disposed between the thin bricks. The mortar flows into the holes and between the top surface of the thin bricks and the bottom surface of the leg portion of the L-shaped retainers creating an improved mortar lock between the bricks and the support panel.

It is an object of the present invention to provide an improved brick veneer assembly and related method.

It is another object to provide a brick veneer assembly capable of accommodating dimensional variation of bricks in a manner that does not interfere with other bricks.

It is still another object to provide a support panel that offers improved brick retention compared to the prior art.

It is yet another object to provide a brick veneer assembly and related method that does not rely on adhesive for brick retention before the mortar is applied.

It is a further object to provide a brick veneer assembly and related method that offers improved mortar interlock compared to the prior art.

It is still a further object to provide a more positive brick location means to prevent movement of the bricks while the mortar sets.

It is yet a further object to provide a less expensive and less labor intensive brick veneer assembly and related method.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
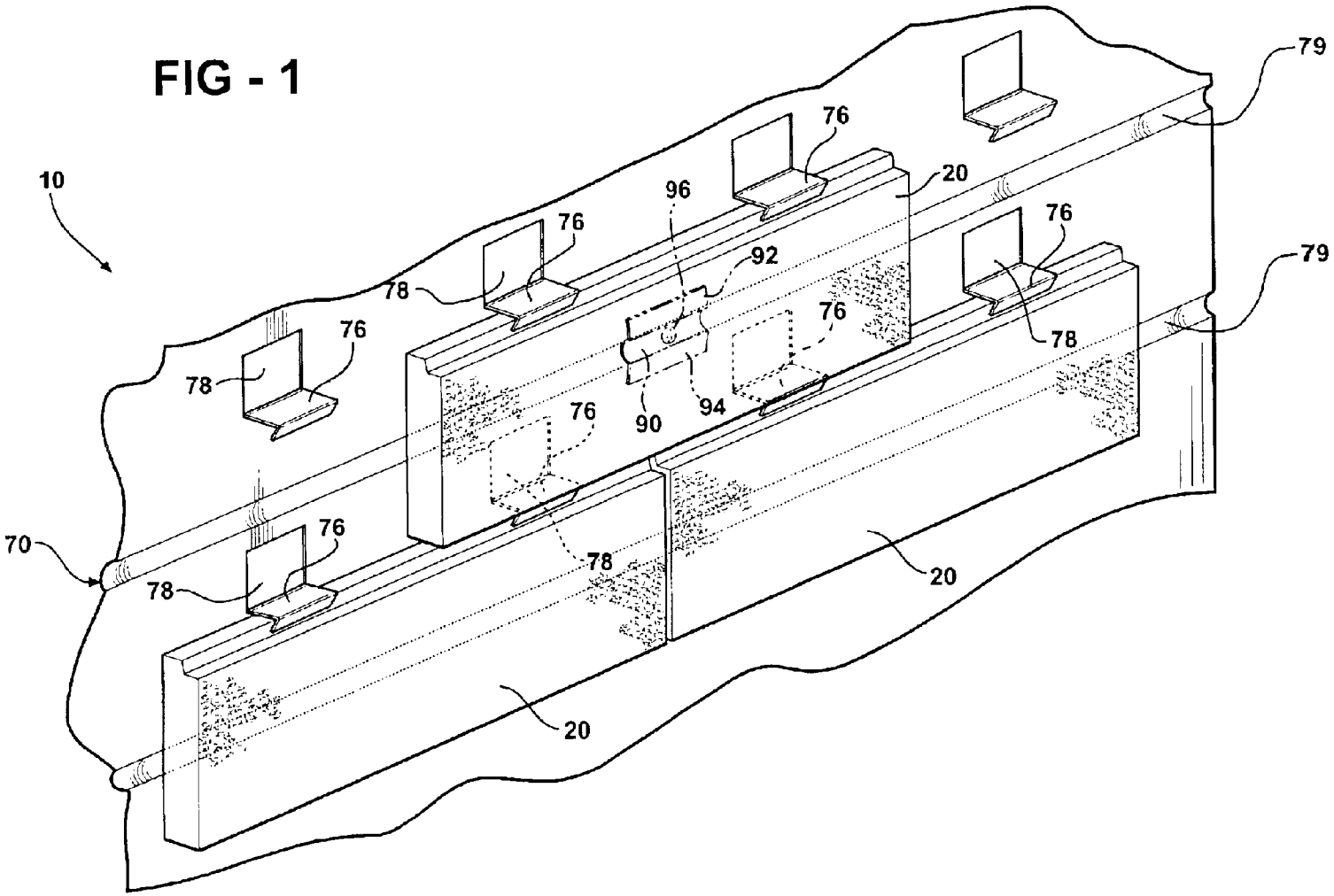
FIG. 1 is a partial exploded perspective view of a brick panel assembly according to the present invention.

Generally shown in the Figures, a brick veneer assembly is provided in accordance with the present invention. While the figures depict an embodiment of the present invention in which thin bricks are applied to an exterior wall of a building, it should be appreciated that the present invention also teaches the application of other materials (i.e. tile, stone, etc.) to a variety of surfaces (i.e. interior walls, floor, ceiling, etc.). Referring to the Figures, there is shown in FIG. 1 a portion of a brick veneer assembly 10 that is constructed in accordance with a method of the present invention. The brick veneer assembly 10 includes thin bricks 20, a support panel 70, and mortar (not shown). The brick veneer assembly of FIG. 1 depicts the thin bricks arranged in rows, however, it should be understood that other thin brick arrangements could be adopted by one of ordinary skill in the art.

Figure 2:
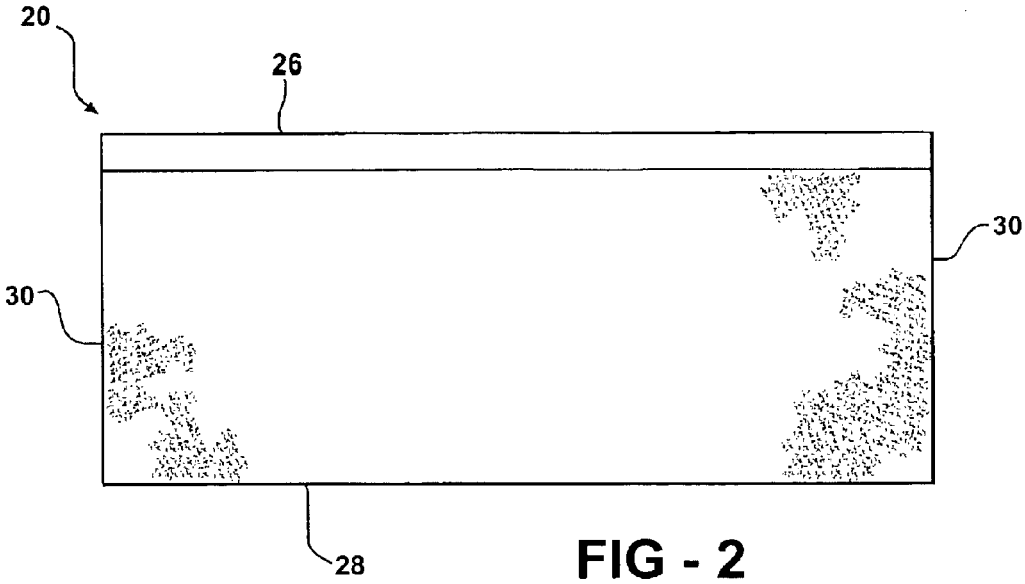
FIG. 2 is a front view of the brick shown in FIG. 1.
Figure 3:
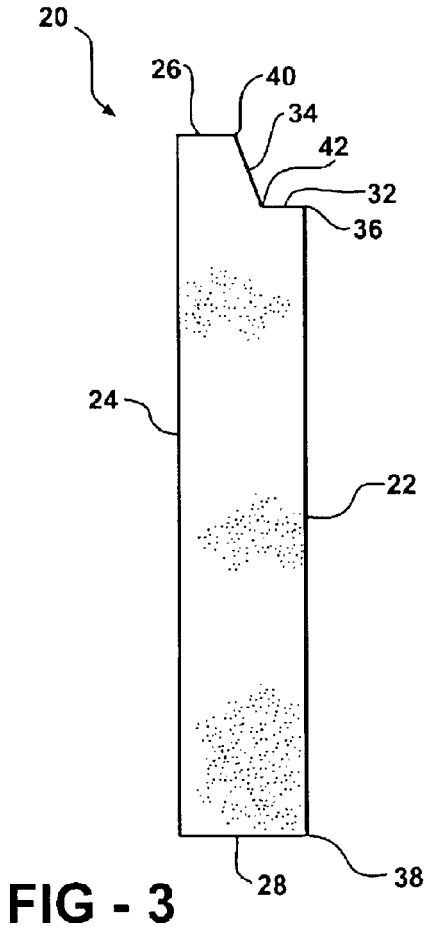
FIG. 3 is a side view of the brick shown in FIG. 1.

Referring now to FIGS. 2 and 3, the thin bricks 20 are generally rectangular and each, as viewed when assembled on a wall, has a front surface 22, a back surface 24, a top surface 26, a bottom surface 28, opposed side surfaces 30, a stepped surface 32 and a tapered locating surface 34. Although the stepped surface 32 and the tapered locating surface 34 are taught as part of a preferred embodiment, it is within the scope of this disclosure that a top surface (not shown) of a thin brick (not shown) may be a complete tapered surface between the front surface 22 and the back surface 24.

The width of each thin brick 20 is defined between the opposed side surfaces 30, the height is defined between the top surface 26 and the bottom surface 28, and the thickness or depth is defined between the front surface 22 and the back surface 24. Most manufacturing processes known in the art for producing the thin bricks 20 introduce variation such that some bricks are oversized and some are undersized. The manufacturing variation thereby defines a maximum width, height and depth, and a minimum width, height and depth.

Figure 4:
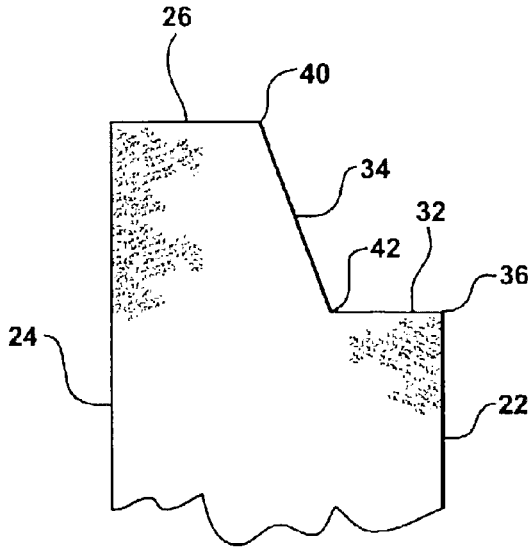
FIG. 4 is a partial exploded side view of the brick shown in FIG. 3.

As best seen in FIGS. 3 and 4, the back surface 24 of each thin brick 20 is higher than the front surface 22 of the thin brick 20. In the preferred embodiment, the top surface 26, the stepped surface 32, and the bottom surface 28 are approximately parallel. The stepped surface 32 extends generally perpendicularly from the front surface 22 of the thin brick 20 in a direction toward the back surface 24 of the thin brick 20. The tapered locating surface 34 connects the stepped surface 34 and the top surface 26 of the thin brick 20, and tapers in a direction toward the back surface 24 of the thin brick 20.

Figure 5:
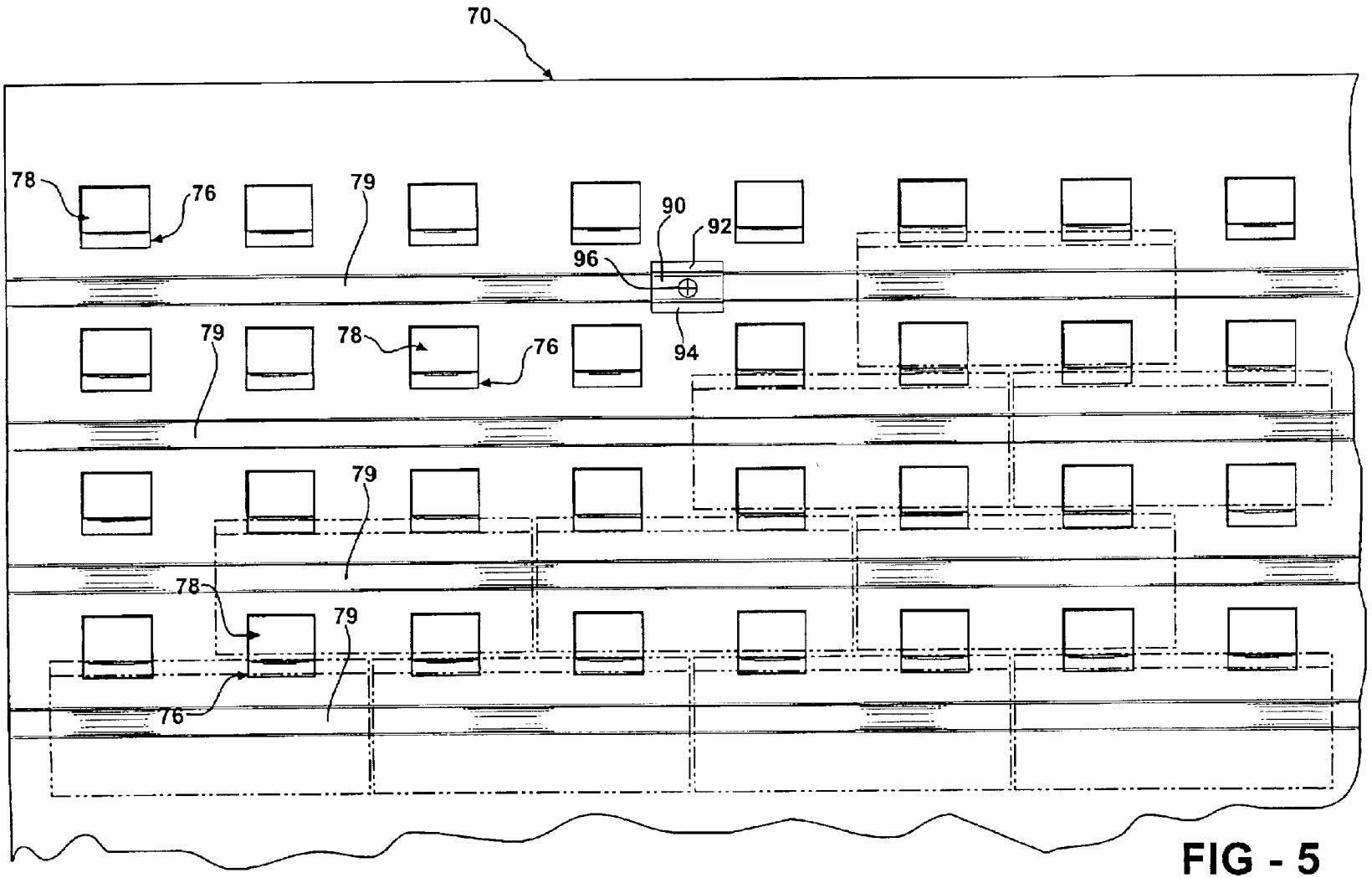
FIG. 5 is a front view of the support panel shown in FIG. 1.
Figure 6:
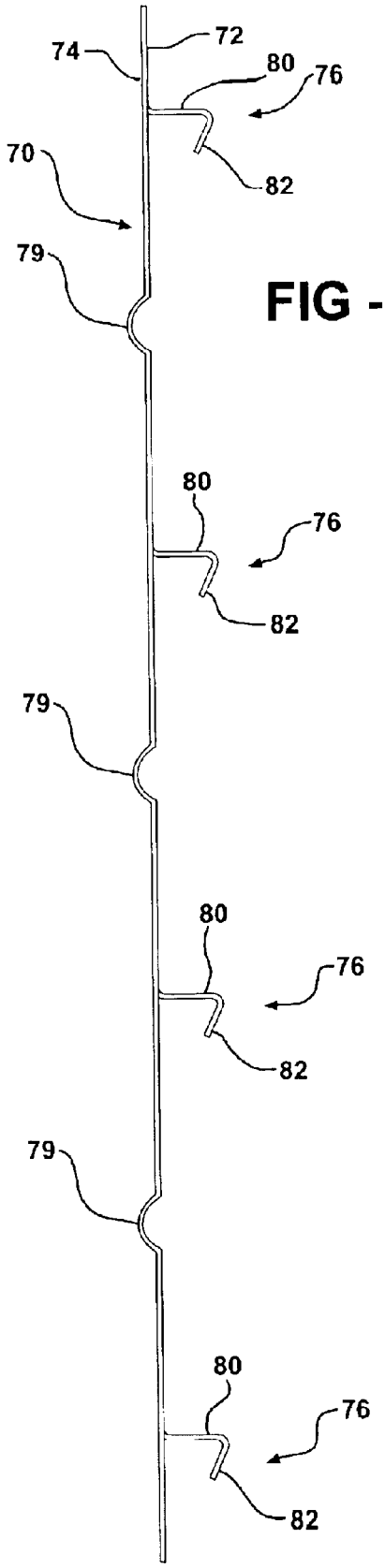
FIG. 6 is a side view of the support panel shown in FIG. 1.

Referring now to FIGS. 5 and 6, the support panel 70 has a front surface 72, a rear surface 74, a plurality of rows of resilient L-shaped retainers 76 and a corresponding plurality of rows of holes 78. The support panel 70 is preferably composed of thin sheet metal or aluminum, and includes a plurality of stiffening channels 79 configured to reinforce the support panel 70. The stiffening channels 79 extend along the entire length of the support panel 70 and are fabricated in the panel so as to not interfere with the positioning of the thin bricks 20 on the support panel 70. This may be accomplished by locating the stiffening channels 79 between the L-shaped retainers 76 in any conventional manner. Each resilient L-shaped retainer 76 is punched out of the support panel 70 such that the hole 78 is generated in the region from which the material forming the L-shaped retainer 76 was taken.

Figure 7:
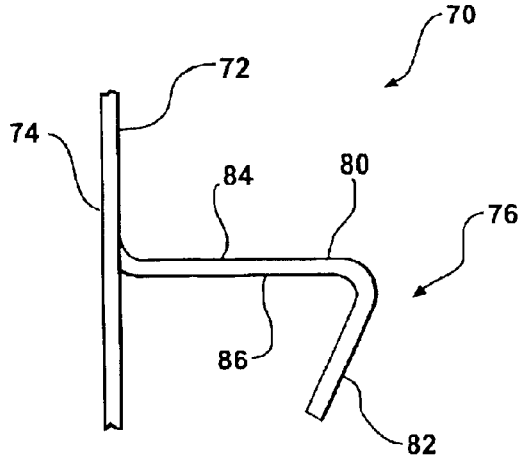
FIG. 7 is a partial exploded side view of the support panel shown in FIG. 6.

As best seen in FIG. 7, each L-shaped retainer 76 has a leg portion 80 and a foot portion 82. The leg portion 80 has a top surface 84 and a bottom surface 86, and extends away from the front surface 72 of the support panel 70. The foot portion 82 extends downward from the leg portion 80 and inward toward the front surface 72 of the support panel 70 such that engagement of the tapered locating surface 34 of the thin bricks 20 resiliently deforms the foot portion 82 away from the support panel 70 thereby creating an interference fit between the thin brick 20 and the resilient L-shaped retainer 76 as clearly shown in FIG. 9 which will be hereinafter described in detail.

Figure 9:
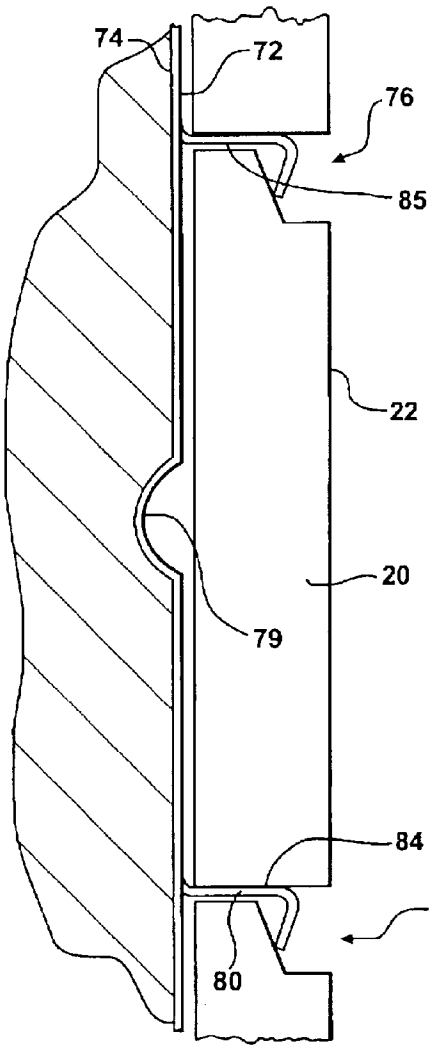
FIG. 9 is a side view of a brick as assembled to the support panel.

Referring again to FIG. 6, the vertical distance between the leg portions 80 of adjacent rows of L-shaped retainers 76 is greater than the maximum height of an oversized brick (not shown). Furthermore, the foot portion 82 of the L-shaped retainers 76 is sufficiently long to engage the tapered locating surface 34 of an undersized brick (not shown) seated on an adjacent L-shaped retainer 76 directly below. As best seen in FIG. 9, a clearance 85 (shown in FIG. 9) is provided between the top surface 26 of the thin bricks 20 and the bottom surface 86 of a respective L-shaped retainer 76 to accommodate oversized bricks. Additionally, the interference fit between the foot portion 82 of the L-shaped retainer 76 and the tapered locating surface 34 of the thin bricks 20 is adapted to accommodate undersized bricks.

Figure 10:
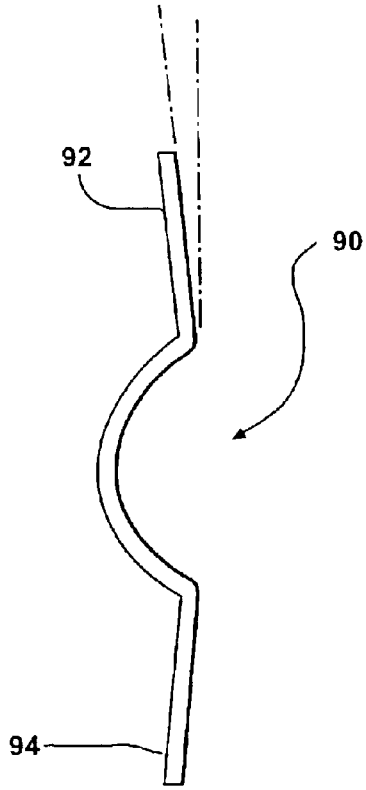
FIG. 10 is an exploded side view of a support washer according to the present invention.

As seen in FIGS. 1 and 5, the rear surface 74 of the support panel 70 is attached to a wall of a building structure with fasteners such as nails or screws 96. Optionally, a support washer 90 (best seen in FIG. 10) may be implemented to prevent the support panel 70 from tearing out around the fasteners 96 and to increase the holding power of the fasteners 96. The support washer 90 preferably has an upper flange 92 adapted to engage the front surface 72 of the support panel 70 above a corresponding stiffening channel 79, and a lower flange 94 adapted to engage the front surface 72 of the support panel 70 below the corresponding stiffening channel 79, the remaining portion of the support washer 90 is disposed within the corresponding stiffening channel 79. The stiffening channels 79 and support washer 90 are shown having a radial cross-sections, however a person skilled in the art will recognize that other cross-section configurations may be adopted. The upper and lower flanges 92, 94 are configured to provide preload upon engagement with the support panel 70. Accordingly, the uppermost edge of the upper flange 92 and the lowermost edge of the lower flange 94 taper inward toward the wall whereby the fastener 96 deforms the upper and lower flanges 92, 94 whereby the support washer 90 is drawn into the support panel 70. The support washer 90 configured as disclosed hereinabove provides increased vertical support such that incorporation thereof is particularly appropriate for applications wherein the brick veneer assembly 10 covers a large surface area, is excessively heavy, or is subjected to extreme wind load.

Figure 8:
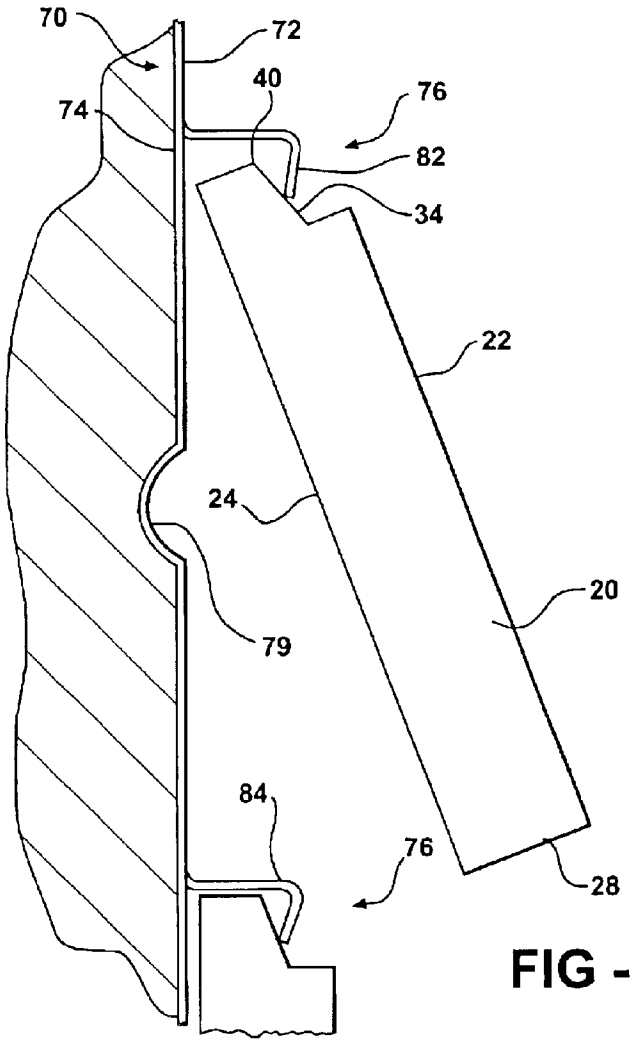
FIG. 8 is a side view of a brick being assembled to the support panel.

Referring now to FIGS. 8 and 9, the back surface 24 of each thin brick 20 is then mounted against the front surface 72 of the support panel 70 at an angled approach such that the tapered locating surface 34 is introduced into the space between the front surface 72 of the support panel 70 and the foot portion 82 of respective L-shaped retainers 76. The angle of the tapered locating surface 34 is provided so that the top surface 40 of the thin brick 20 is inserted between the front surface 72 of the support panel 70 and the foot portion 82 of the respective L-shaped retainer 76. As the thin brick 20 is advanced toward the support panel 70, the foot portion 82 of the respective L-shaped retainer 76 engages the tapered locating surface 34 to create the interference fit.

After the thin brick 20 is initially inserted into the L-shaped retainer 76 at an angled approach, the thin brick 20 is pushed flat against the front surface 72 of the support panel 70 such that the bottom surface 28 rests on the top surface 84 of leg portion 80 of the adjacent row below. As the foot portion 82 of respective L-shaped retainers 76 engage the tapered locating surface 34 during the initial angled insertion of the brick 20, the process of pushing the thin brick 20 flat against the support panel 70 resiliently moves the foot portion 82 of the respective L-shaped retainer 76 away from the support panel 70. In this manner, the foot portion 82 of the respective L-shaped retainer 76 applies a force to the tapered locating surface 34 of the thin brick 20 such that the thin brick 20 is secured in place against the support panel 70. The L-shaped retainer 76 holds the thin brick 20 against the support panel 70 tightly enough to prevent the thin brick 20 from shifting while mortar is applied and/or setting, however, additional retention is obtainable with the optional application of a temporary adhesive (not shown) between the thin brick 20 and the support panel 70.

Referring again to FIG. 1, after the support panel 70 is attached to the wall structure (not shown), and the thin bricks 20 are applied to the support panel 70, mortar (not shown) is disposed between the thin bricks 20. The mortar is preferably applied with a single point applicator nozzle and mortar pump system or in accordance with any other method well known in the art. The mortar flows into the holes 78 and between the top surface 26 of the thin bricks 20 and the bottom surface 86 of the leg portion 80 of the L-shaped retainers 76 creating an improved mortar lock between the thin bricks 20 and the support panel 70.

As is understood from the above discussion, the present invention provides improved accommodation of the tolerance variation of the bricks by providing a more resilient system for locating and retaining the bricks. Specifically, the present invention does not rely on oppositely disposed parallel surfaces of the brick as in the prior art, but rather provides a retention system based on an interference fit between a stepped locating feature of the brick and resilient L-shaped retainers such that the retention system is capable of accommodating both oversized and undersized bricks regardless of tolerance variation of the brick. Furthermore, the retention system is effective without the use of adhesive relied upon by the prior art so that the present invention is simpler to assemble and less expensive. Finally, the holes in the support panel enable better interlocking of the mortar, the bricks and the support panel.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. A Specific example includes substituting the steel support panel with aluminum or plywood. Accordingly, the scope of the present invention is to be limited only by the following claims.

What is claimed is:

1. A brick veneer support assembly supporting a plurality of wall forming members, each wall forming member having a front surface; a back surface opposite said front surface; a bottom surface substantially perpendicular to said front and back surfaces; and a top surface having at least a portion formed at an acute angle to said back surface, said support assembly comprising:

a support panel having a plurality of resilient retainers formed therein, said plurality of resilient retainers being formed in adjacent rows spaced a predetermined distance apart, said predetermined distance being greater than the maximum height of each of said wall forming member, each of said plurality of resilient retainers having a leg portion extending in a direction away from said support panel, said leg portion having a top surface for supporting said bottom surface of each of said wall forming members; a bottom surface opposite said top surface; and a foot portion attached to said leg portion, said foot portion having one end extending in a downward direction at an acute angle to said leg portion and towards said support panel;

a clearance gap defined between said bottom surface of said leg portion of each of said plurality of resilient retainers and said top surface of each of said plurality of wall forming members;

means for creating a restraining force on each of said at least one acute angle portion of said top surface of each of said wall forming members, said restraining force having a force component directed towards said back surface of each of said wall forming members and a force component directed downwards from said top surface towards said bottom surface of each of said wall forming members whereby said plurality of wall forming members securely mount to said support panel regardless of the size variation of each of said wall forming members within a predetermined tolerance range; and means for disposing mortar between said plurality of wall forming members to permanently bond said wall forming members to said support panel whereby when said mortar is applied to said support panel said mortar flows between said plurality of wall forming members and into said clearance gap interlocking said plurality of wall forming members with said support panel.

2. The support assembly as claimed in claim 1, wherein each of said wall forming members further has a stepped surface from which said at least formed portion of said top surface depends.

3. The support assembly as claimed in claim 1, wherein said plurality of resilient retainers are arranged to form multiple rows of resilient retainers.

4. The support assembly as claimed in claim 1, wherein said foot portion of said plurality of resilient retainers extending in a downward direction at an acute angle to said leg portion and toward said support panel such that initial engagement of said at least one formed portion of said top surface of each said wall forming members resiliently deforms said foot portion away from said support panel thereby creating a restraining force.

5. The support assembly as claimed in claim 4, wherein said foot portion of said plurality of resilient retainers is of a predetermined length sufficient to engage an undersized wall forming member mounted on one of said multiple rows of resilient retainers located vertically adjacent and directly below.

6. The support assembly as claimed in claim 1, wherein said support panel further comprises a plurality of holes, whereby application of said mortar flows into said plurality of holes interlocking said plurality of wall forming members to said support panel.

7. The support assembly as claimed in claim 1, further comprising a temporary adhesive applied between said support panel and said plurality of wall forming members.

8. A brick veneer support panel assembly comprising:

a plurality of bricks, each brick having a front surface; a back surface opposite said front surface; a bottom surface substantially perpendicular to said front and back surfaces; a bottom surface; and a top surface defining a tapered locating surface portion;

a support panel having a plurality of resilient retainers formed therein, said plurality of resilient retainers being arranged to form multiple rows of resilient retainers spaced a predetermined distance apart, said predetermined distance being greater than the maximum height of each of said plurality of bricks, each said resilient retainer having a leg portion extending in a direction away from said support panel, said leg portion having a top surface for supporting said bottom surface of each of said plurality of bricks; a bottom surface opposite said top surface; and a foot portion attached to said leg portion and having one end extending in a downward direction at an acute angle to said leg portion and towards said support panel;

means for attaching each brick of said plurality of bricks to said support panel, said attaching means comprising:

means for locating said bottom surface of each of said plurality of bricks in contact with said top surface of a first row of said plurality of resilient retainers and further locating said tapered locating surface against said foot portion of an adjacent row of said plurality of resilient retainers to define a clearance gap between said bottom surface of said leg portion of each of said plurality of resilient retainers and said top surface of each of said plurality of bricks; and means for creating a restraining force on said tapered locating surface portion of said top surface of each of said plurality of bricks, said restraining force having a force component directed towards said back surface of each of said plurality of bricks and a force component directed downwards from said top surface towards said bottom surface of each of said plurality of bricks whereby said plurality of bricks securely mounts to said support panel regardless of the size variation of each of said plurality of bricks within a predetermined tolerance range; and means for disposing mortar between said plurality of bricks to permanently bond said plurality of bricks to said support panel whereby when said mortar is applied to said support panel said mortar flows between each of said plurality of bricks and into said clearance gap interlocking said plurality of bricks to said support panel.

9. The brick veneer support panel assembly as claimed in claim 8, wherein said top surface of said plurality of bricks further comprises a stepped surface between said front surface and said tapered locating surface portion.

10. The brick veneer support panel assembly as claimed in claim 8, wherein said means for creating a restraining force on said tapered surface portion comprises said foot portion of said plurality of resilient retainers depending downward from said leg portion and toward said front portion of said support panel such that initial engagement of said tapered locating surface portion of said plurality of bricks elastically deforms said foot portion away from said support panel to create said force components.

11. The brick veneer support panel assembly as claimed in claim 8, wherein said foot portion of said plurality of resilient retainers is of a predetermined length sufficient to engage an undersized brick seated on an adjacent row of said multiple rows of resilient retainers located vertically adjacent and directly below.

12. The brick veneer support panel assembly as claimed in claim 11, wherein said means for disposing said mortar between said plurality of bricks flows mortar into said clearance gap interlocking said plurality of bricks to said support panel.

13. The brick veneer support panel assembly as claimed in claim 8, wherein said support panel further comprises a plurality of holes, whereby said mortar flows into said plurality of holes interlocking said plurality of bricks to said support panel.

14. The brick veneer support panel assembly as claimed in claim 8 further comprising a temporary adhesive applied between said support panel and said plurality of bricks.

* * * * *